US006382601B1

(12) United States Patent
Ohnari

(10) Patent No.: US 6,382,601 B1
(45) Date of Patent: May 7, 2002

(54) SWIRLING FINE-BUBBLE GENERATOR

(76) Inventor: Hirofumi Ohnari, 15-20, Jyogaoka 3-chome, Tokuyama-shi, Yamaguchi 745-0807 (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/380,246

(22) PCT Filed: Jan. 4, 1999

(86) PCT No.: PCT/JP99/00001

§ 371 Date: Aug. 30, 1999

§ 102(e) Date: Aug. 30, 1999

(87) PCT Pub. No.: WO99/33553

PCT Pub. Date: Jul. 8, 1999

(30) Foreign Application Priority Data

Dec. 30, 1997 (JP) ..... 9-370465

(51) Int. Cl.[7] ..... B01F 3/04
(52) U.S. Cl. ..... 261/79.2; 261/123
(58) Field of Search ..... 261/79.2, 79.1, 261/108, 123

(56) References Cited

U.S. PATENT DOCUMENTS

| | | | | | |
|---|---|---|---|---|---|
| 2,653,801 | A | * | 9/1953 | Fontein et al. | 261/79.2 |
| 3,238,021 | A | * | 3/1966 | Webber et al. | 261/79.2 |
| 3,775,314 | A | * | 11/1973 | Beitzel et al. | 261/79.2 |
| 3,862,907 | A | * | 1/1975 | Shimotsuma et al. | 261/79.2 |
| 4,267,131 | A | * | 5/1981 | Prudhon et al. | 261/79.2 |
| 4,571,311 | A | * | 2/1986 | Ferguson, Jr. et al. | 261/79.2 |
| 4,834,343 | A | * | 5/1989 | Boyes | 261/79.2 |

FOREIGN PATENT DOCUMENTS

| | | | | |
|---|---|---|---|---|
| DE | 2820617 | * | 11/1979 | 261/79.2 |
| FR | 1071111 | * | 8/1954 | 261/79.2 |
| JP | 48-6211 B1 | | 2/1973 | |
| JP | 50-31471 | | 3/1975 | |
| JP | 51-28865 | | 3/1976 | |
| JP | 54-41247 B2 | | 12/1979 | |
| JP | 59-24199 | | 2/1984 | |
| NL | 7009279 | * | 12/1970 | 261/79.2 |

* cited by examiner

*Primary Examiner*—C. Scott Bushey
(74) *Attorney, Agent, or Firm*—Armstrong, Westerman & Hattori, LLP

(57) ABSTRACT

The swirling type micro-bubble generating system according to the present invention has a container main unit having a conical space or a bottle-like space, a liquid inlet provided in tangential direction on a part of circumferential surface of inner wall of said space, a gas introducing hole provided on the bottom of said space, and a swirling gas-liquid outlet arranged at the top of said space. According to this system, it is possible to readily generate micro-bubbles in industrial scale, and the system is relatively small in size and has simple structure and can be easily manufactured. The system can be used in the applications such as purification of water quality in ponds, lakes, marshes, man-made lakes, rivers, etc., for processing of polluted water using microorganisms, culture of fishes and other aquatic animals, and increase of oxygen and dissolved oxygen in culture solution in hydroponic culture farm and improvement of production yield.

7 Claims, 11 Drawing Sheets

SWIRLING FINE-BUBBLE GENERATOR

FIELD OF THE INVENTION

The present invention relates to a micro-bubble generating system for efficiently dissolving gas such as the air, oxygen gas, etc. into liquid such as city water, river water, etc., for purifying polluted water and for effectively utilizing the water for reconditioning and renewal of water environment.

BACKGROUND ART

In conventional type aeration systems, e.g. in most of aeration systems using micro-bubble generating system installed for culture and growth of aquatic animals, air bubbles are generated by injecting the air under pressure into water through fine pores of tubular or planar micro-bubble generating system installed in the tank, or air bubbles are generated by introducing the air into water flow with shearing force or by vaporizing the air dissolved in water by rapidly reducing pressure of the pressurized water.

In the aeration process using the micro-bubble generating system with the above functions, operation is basically controlled by adjusting the air supply quantity or the number of the micro-bubble generating systems to be installed, while it is necessary to efficiently dissolve gas such as air, carbon dioxide, etc. into water and further to promote circulation of the water.

However, in the aeration system using the conventional type micro-bubble generating system, e.g. diffusion system based on injection, even when fine pores are provided, when air bubbles are injected under pressure through pores, volume of each of the air bubbles is expanded, and diameter of each air bubble is increased to several millimeters due to surface tension of the air bubbles during injection. Thus, it is difficult to generate air bubbles of smaller diameter. Also, there are problems such as clogging of the pores or increase of power consumption caused by the operation for long time.

In the system to generate the air bubbles by introducing the air into water flow with shearing force using vanes and air bubble jet stream, it is necessary to have higher number of revolutions to generate cavitation. Also, there are problems of power consumption increase and the problem of corrosion of vanes or vibration caused by generation of cavitation. Further, there are problems in that only a small amount of micro-bubbles can be generated.

In the system where gas-liquid two-phase flow collides with the moving vane or projection, fishes or small aquatic animals in natural lakes or culture tanks may be injured, and this causes trouble in the development and maintenance of the environmental condition necessary for the growth of fishes and other aquatic animals.

Further, in the pressurizing system, the system must be designed in larger size and requires higher cost, and operation cost is also high.

In none of the prior art in this field as described above, it has been possible to generate micro-bubbles with diameter of not more than 20 $\mu$m in industrial scale.

SUMMARY OF THE INVENTION

After fervent study efforts, the present inventors have successfully developed the present invention, by which it is possible to generate micro-bubbles with diameter of not more than 20 $\mu$m in industrial scale.

As shown in FIG. 12, which indicates the principle of the system according to the present invention, a micro-bubble generating system is provided, which comprises a conical space 100 in a container, a pressure liquid inlet 500 provided in tangential direction on a part of circumferential surface of inner wall of the space, a gas introducing hole 80 opened at the center of the bottom 300 of the conical space, and a swirling gas-liquid outlet 101 near the top of the conical space.

The entire system or at least the swirling gas-liquid outlet 101 is submerged in the liquid, and by sending pressure liquid from the pressure liquid inlet 500 into the conical space 100, a swirling flow is formed inside, and negative pressure is generated along the axis of the conical tube. By this negative pressure, the gas is sucked through the gas introducing hole 80. As the gas passes along the axis of the tube where the pressure is at the lowest, a narrow swirling gas cavity 60 is generated.

In the conical space 100, a swirling flow is generated from the inlet (pressure liquid inlet) 500 toward the outlet (swirling gas-liquid outlet) 101. As cross-sectional area of the space 100 is gradually reduced toward the swirling gas-liquid outlet 101, both the swirling velocity and velocity of the flow directed toward the outlet are increased at the same time.

In association with this swirling, centrifugal force is applied on the liquid and centripetal force is applied on the air at the same time because of the difference of specific gravity between the liquid and the gas. As a result, the liquid portion and the gas portion become separable from each other, and the gas is turned to a narrow thread-like gas swirling cavity 60, which is narrowed down and runs continuously up to the outlet 101 and is then injected through the outlet. At the same time as the injection, swirling is rapidly weakened by the surrounding stationary water. Then, radical difference in swirling velocity occurs before and after that point. Because of the difference of swirling velocity, the thread-like gas cavity 60 is cut off in continuous and stable manner. As a result, a large amount of micro-bubbles, e.g. micro-bubbles of 10 to 20 $\mu$m in diameter, are generated near the outlet 101 and are discharged.

Specifically, the present invention provides:

(1) a swirling type micro-bubble generating system, comprising a container main unit having a conical space, a pressure liquid inlet provided in tangential direction on a part of circumferential surface on inner wall of the space, a gas introducing hole opened on the bottom of the conical space, and a swirling gas-liquid outlet arranged at the top of the conical space;

(2) a swirling type micro-bubble generating system, comprising a container main unit having a truncated conical space, a pressure liquid inlet provided in tangential direction on a part of circumferential surface on inner wall of the space, a gas introducing hole opened on the bottom of the truncated conical space, and a swirling gas-liquid outlet arranged in the upper portion of the truncated conical space;

(3) a swirling type micro-bubble generating system, comprising a container main unit having a space of bottle-like shape, a pressure liquid inlet provided in tangential direction on a part of circumferential surface on inner wall of the space, a gas introducing hole opened on the bottom of the bottle-like space, and a swirling gas-liquid outlet arranged at the top of the bottle-like space;

(4) a swirling type micro-bubble generating system according to one of (1) to (3) above, wherein a plurality of pressure liquid inlets are provided with spacings in tangential direction on a part of circumferential surface having the same radius of curvature on inner wall of the space;

(5) a swirling type micro-bubble generating system according to one of (1) to (4) above, wherein a plurality of pressure liquid inlets are provided with spacings in tangential direction on a part of circumferential surface having different radii of curvature on inner wall of the space;

(6) a swirling type micro-bubble generating system according to one of (1) to (5) above, wherein the pressure liquid inlet is provided on a part of circumferential surface of inner wall near the bottom of the space;

(7) a swirling type micro-bubble generating system according to one of (1) to (6) above, wherein the pressure liquid inlet is provided on a part of circumferential surface of inner wall near a point halfway down of the space; and (8) a swirling type micro-bubble generating system according to one of (1) to (7) above, wherein a baffle plate is arranged downstream of the swirling gas-liquid outlet.

In the other aspects, the present invention further provides:

(9) a swirling type micro-bubble generating system, comprising a liquid flow swirling introducing structure of a circular accommodation chamber on a lower flow base, a swirling ascending liquid flow forming structure formed on inner peripheral portion of a covered cylinder with diameter gradually increased in upward direction, a swirling descending liquid flow forming structure formed inside the peripheral portion, a swirling cavity under negative pressure formed at the center of said covered cylinder by separating action of centrifugal and centripetal forces of the swirling ascending liquid flow and the swirling descending liquid flow, a gas vortex flow forming structure where a swirling and descending gas vortex flow is formed as gas self-sucked from gas self-sucking pipe mounted at the center of upper cover and gas components eluted from the swirling water flow are accumulated, said gas vortex flow being extended and narrowed down, a micro-bubble generating structure for generating micro-bubbles as gas vortex flow is forcibly cut off when the extended and narrowed gas vortex flow enters the central reflux port at the bottom of the circular accommodation chamber, swirling velocity decreased due to resistance of the discharge passage, thereby causing difference in swirling velocity, and a swirling injection flow discharge structure for discharging liquid flow through a lateral discharge port as swirling injection flow including the generated micro-bubbles in the swirling descending liquid flow;

(10) a swirling micro-bubble generating system, wherein there is provided a liquid flow swirling introducing structure in the circular accommodation chamber, a circular accommodation chamber is provided on upper portion of the lower flow base, a liquid flow inlet is opened in tangential direction with respect to inner peripheral surface from lateral direction on said circular accommodation chamber, and a pump is connected to introduce water flow forcibly and swirling;

(11) a swirling type micro-bubble generating system, wherein there is provided a dual swirling liquid flow forming structure of the swirling ascending liquid flow and the swirling descending liquid flow in the covered cylinder with its diameter gradually increased in upward direction, a covered cylinder with diameter gradually increased in upward direction is erected vertically on upper portion of said circular accommodation chamber, the swirling introducing flow of the circular accommodation chamber is introduced, a swirling ascending liquid flow is formed by swirling and ascending along the peripheral portion in the covered cylinder, when the swirling ascending liquid flow reaches the upper limit, it is sent back to inner portion from peripheral portion to swirl and descend, thus forming a swirling descending liquid flow;

(12) a swirling type micro-bubble generating system, wherein there is provided a gas vortex flow forming structure, a swirling cavity under negative pressure is formed at the central portion by centrifugal and centripetal forces of dual swirling flow of the swirling ascending liquid flow and the swirling descending liquid flow inside the covered cylinder with diameter gradually increased in upward direction, self-sucking gas and gas components eluted from said swirling flow are accumulated in said swirling cavity under negative pressure, and swirling descending gas flow is formed while being extended and narrowed down;

(13) a swirling type micro-bubble generating system, wherein said system comprises a micro-bubble generating structure, and a central reflux port is provided at the bottom center of said circular accommodation chamber, a discharge passage is provided from said reflux port to a lateral discharge port of said flow base, and when the gas vortex flow swirling and descending while being extended and narrowed down in the central portion inside the covered cylinder enters and flows out of the central reflux port, the gas vortex flow undergoes resistance from the discharge passage and the swirling velocity is decreased, thereby causing swirling velocity difference between upper and lower portions of the vortex flow, the vortex flow is forcibly cut off due to the velocity difference, and micro-bubbles are generated;

(14) a swirling type micro-bubble generating system, wherein said system comprises a micro-bubble generating structure, a plurality of lateral discharge ports are formed in radial direction on the central reflux port, the gas vortex flow swirling and descending through the central portion of said covered cylinder is sent through the central reflux port toward said plurality of lateral discharge ports in the order of the swirling direction, resistance from the passage caused by the flow into the lateral discharge ports and resistance from the passage due to collision against side wall of the reflux port are repeatedly and alternatively applied for a plurality of times, swirling velocity difference is generated between upper and lower portions of the vortex flow each time the flow undergoes the resistance, and the vortex flow is cut off, and micro-bubbles are generated;

(15) a swirling type micro-bubble generating system, wherein a connection pipe for discharge as provided on the lateral discharge port of said flow base is bent and protruded in such manner as to follow the swirling flow forming direction in said covered cylinder; and

(16) a method for swirling type micro-bubble generation, using a micro-bubble generating system, which comprises a container main unit having a conical space, a pressure liquid introducing port opened in tangential direction on a part of circumferential surface of inner wall of said space, a gas introducing hole opened at the bottom of said conical space, and a swirling gas-liquid discharge outlet opened at the top of said conical space, whereby said method comprises a first step of forming a gas vortex flow swirling and flowing while being extended and narrowed down in said conical space, and a second step of generating micro-bubbles when the gas vortex flow is forcibly cut off due to the difference of swirling velocity between front portion and rear portion of the gas vortex flow.

BEST MODE FOR CARRYING OUT THE INVENTION

Figure 12:
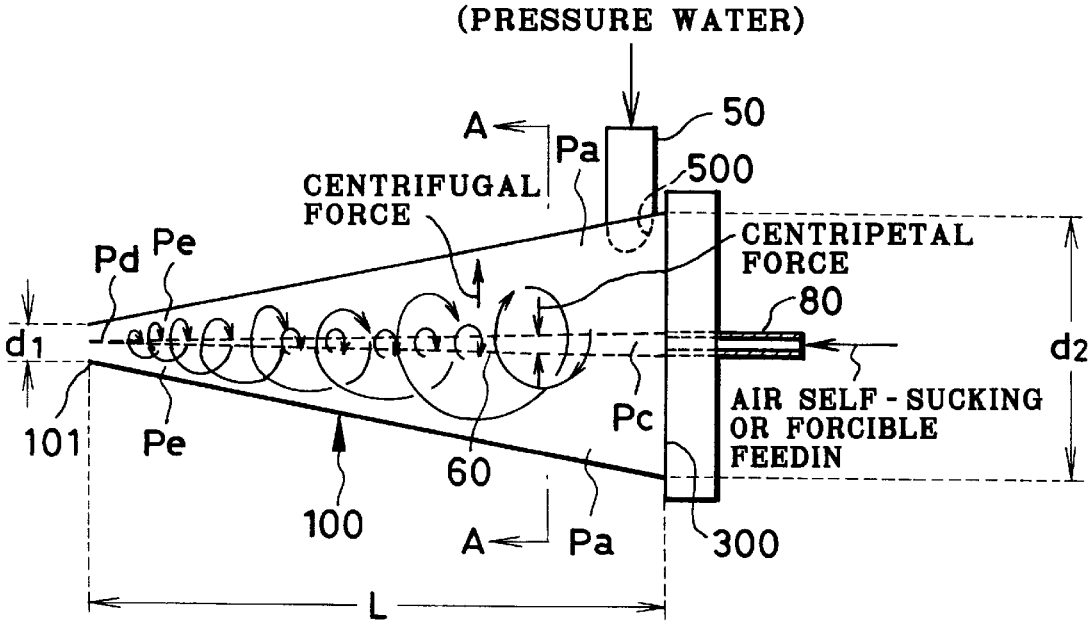
FIG. 12 is to explain a system of another embodiment, also serving to explain the principle of the present invention.
Figure 12:
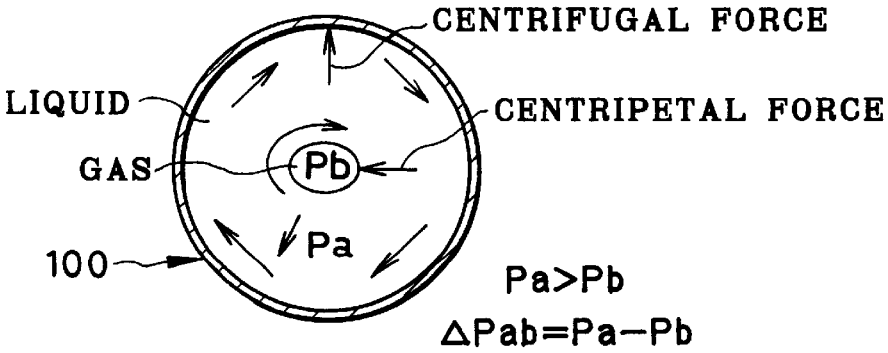

As shown in the drawing to explain the principle of the present invention in FIG. 12, a micro-bubble generating system comprises a conical space 100 formed in a container of the system, a pressure liquid inlet 500 provided in tangential direction on a part of circumferential surface of inner wall of the space, a gas introducing hole 80 arranged at the center of a bottom 300 of the conical space, and a swirling gas-liquid outlet 101 arranged near the top of the conical space.

By forcibly sending the pressure liquid into the conical space 100 through the pressure liquid inlet 500, a swirling flow is formed within the conical space, and negative pressure is generated along the axis of the conical tube. By the negative pressure thus generated, the gas is sucked into the gas introducing hole 80, and the gas passes along the tube axis where the pressure is at the lowest. As a result, a narrow swirling gas cavity 60 is generated.

In the conical space 100, a swirling flow is formed from the inlet (pressure liquid inlet) 500 toward the outlet (swirling gas-liquid outlet). As the cross-sectional area of the space 10 is gradually reduced toward the swirling gas-liquid outlet 101, swirling flow velocity and velocity of the flow directed toward the outlet are increased at the same time.

In association with the swirling, due to the difference of specific gravity between the liquid and the gas, centrifugal force is applied on the liquid and centripetal force is applied on the gas at the same time. As a result, the liquid portion and the gas portion become separable from each other. The gas is turned to a narrow thread-like gas swirling cavity 60 with its diameter gradually reduced toward the outlet 101, and the gas is injected through the outlet. At the same time as this injection, the swirling is rapidly weakened by the surrounding stationary liquid. Thus, radical difference of swirling velocity occurs. By the occurrence of the swirling velocity difference, the thread-like gas cavity 60 is cut off in continuous and stable manner. As a result, a large amount of micro-bubbles, e.g. micro-bubbles with diameter of 10–20 $\mu$m, are generated near the outlet 101 and are discharged.

Figure 6:
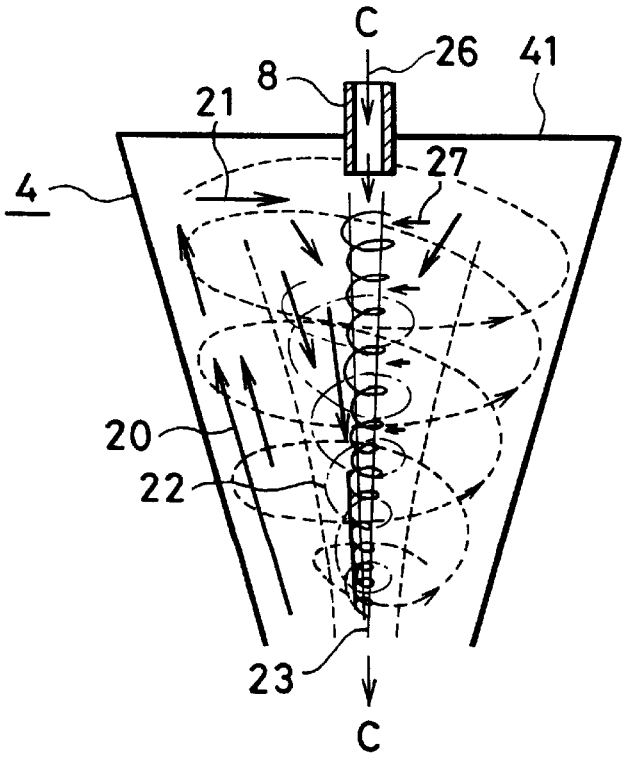
FIG. 6 is a drawing to explain swirling ascending flow and descending flow and a gas vortex flow in the above embodiment along the line Y—Y.

According to another aspect of the invention, as shown in FIG. 6 for example, in a covered cylinder 4 in shape of an inverted circular cone (truncated circular cone) with its diameter gradually increased toward the top, there occur triple swirling flows, i.e. a swirling ascending liquid flow 20 running up along peripheral portion 4*a*, a swirling descending liquid flow 22 running down inside the peripheral portion and a swirling cavity 23 under negative pressure in the central portion. In the swirling cavity 23 under negative pressure, self-sucking gas component 26 and dissolving gas component 27 are accumulated, and a gas vortex flow 24 is formed, which descends and swirls while being extended and narrowed down. When this vortex flow is discharged through the central reflux port 6 in the lower portion, it undergoes resistance from the discharge passage. Then, difference of swirling velocity occurs, and the gas vortex flow itself is forcibly cut off and broken down, and micro-bubbles are generated.

FIG. 12 is a drawing to explain the principle of the system of the present invention. FIG. 12(*a*) is a side view and FIG. 12(*b*) is a sectional view along the line A—A in FIG. 12(*a*).

A micro-bubble generating system comprises a conical space 100 formed in a container of the system of the present invention, a pressure liquid inlet 500 provided in tangential direction on a part of circumferential surface of inner wall of the space, a gas introducing hole 80 arranged at the center of a bottom 300 of the conical space, and a swirling gas-liquid outlet 101 arranged near the top of the conical space.

Normally, the main unit of the system of the present invention is installed under the water surface.

There are two cases: the case where the main unit of the system is installed under the water surface and the case where it is installed outside and in contact with a water tank.

According to the present invention, water is normally used as the liquid and the air is used as the gas. In addition, the liquid may include solvent such as toluene, acetone, alcohol, etc., fuel such as petroleum, gasoline, etc., foodstuff such as edible oil, butter, ice cream, beer, etc., drug preparation such as drug-containing beverage, health care product such as bath liquid, environmental water such as water of lake or marsh, or polluted water from sewage purifier, etc. Further, the gas may include inert gas such as hydrogen, argon, radon, etc., oxidizing agent such as oxygen, ozone, etc., acidic gas such as carbon dioxide, hydrogen chloride, sulfurous acid gas, nitrogen oxide, hydrogen sulfide, etc., and alkaline gas such as ammonia.

In FIG. 12, reference symbol Pa indicates pressure in the swirling liquid flow inside the conical space, Pb represents pressure in the swirling gas flow, Pc represents pressure in the swirling gas flow near the gas inlet, Pd is pressure in the swirling gas flow near the outlet, and Pe represents pressure in the swirling liquid flow at the outlet.

In the conical space 100, pressure liquid is sent under pressure in tangential direction through the liquid inlet 500. Then, a swirling flow is generated from the inlet 500 toward the swirling gas-liquid outlet 101. Because cross-sectional area is gradually reduced toward the outlet 101, both the swirling flow velocity and the velocity of the flow directed toward the outlet are increased at the same time.

In association with the swirling, due to the difference of specific gravity between the liquid and the gas, centrifugal force is applied on the liquid and centripetal force is applied on the gas at the same time. As a result, the liquid portion and the gas portion become separable from each other. The gas is turned to a narrow thread-like gas swirling cavity 60, and the gas flow in thread-like shape under negative pressure is continuously sent to the outlet 101.

Then, the gas is automatically sucked (self-sucked) into the gas introducing hole 80. The gas is then cut off and broken down and sent into the swirling flow with the pressure Pc, i.e. it is turned to air bubbles, and is incorporated in the swirling flow.

As a result, the narrow thread-like gas swirling cavity 60 in the central portion and the liquid swirling flow around the cavity are injected through the outlet 101. At the same time as the injection, the swirling flow is rapidly weakened by the surrounding stationary water. Thus, radical difference in swirling velocity occurs. Because of this difference of swirling velocity, the thread-like gas cavity 60 at the center of the swirling flow is cut off in continuous and stable manner. Then, a large amount of micro-bubbles, e.g. micro-bubbles of 10–20 $\mu$m in diameter, are generated near the outlet 101.

In this figure, the following correlation exists:

$$d_2/d_1 \approx 10 \text{ to } 15;$$

$$L \approx 1.5 \text{ to } 2.0 \times d_2$$

where $d_1$ is diameter of the swirling gas-liquid outlet 101, $d_2$ is diameter of the bottom 300 of the conical space, $d_3$ is diameter of the gas introducing hole 80, and L stands for the distance between the swirling gas-liquid outlet 101 and the bottom 300 of the conical space. The range of numerical values for each type of the system is as given below:

| | $d_1$ | $d_2$ | $d_3$ | L |
|---|---|---|---|---|
| Large-size system | 1.3–2.5 cm | 22–35 cm | 2.6–3.5 mm | 38–70 cm |
| Medium-size system | 5.5–12.0 mm | 10–21 cm | 1.3–2.5 mm | 15–36 cm |
| Small-size system | 2.0–4.5 mm | 2.0–5.0 cm | 0.7–1.2 mm | 3.5–10.0 cm |
| Mini-size system | Not more than 1.5 mm | 0.7–21.5 mm | 0.3–1.0 mm | 1.2–3.0 cm |

In case of a medium-size system, for example, a pump of 2 kW, 200 liters/min., and with head of water of 40 m is used. By the use of this system, a large amount of micro-bubbles can be generated. A layer of micro-bubbles of about 1 cm in thickness can be accumulated over the entire water surface in a water tank with volume of 5 $m^3$. This system can be applied for purification of water in a pond with volume of 2000 $m^3$ or more.

In case of a small-size system, e.g. with a pump of about 30 W and 20 liters/min., the system can be used in a water tank with volume of about 1 to 30 $m^3$.

When the present invention is applied to seawater, micro-bubbles can be very easily generated, and the conditions for application can be further extended.

Figure 15:
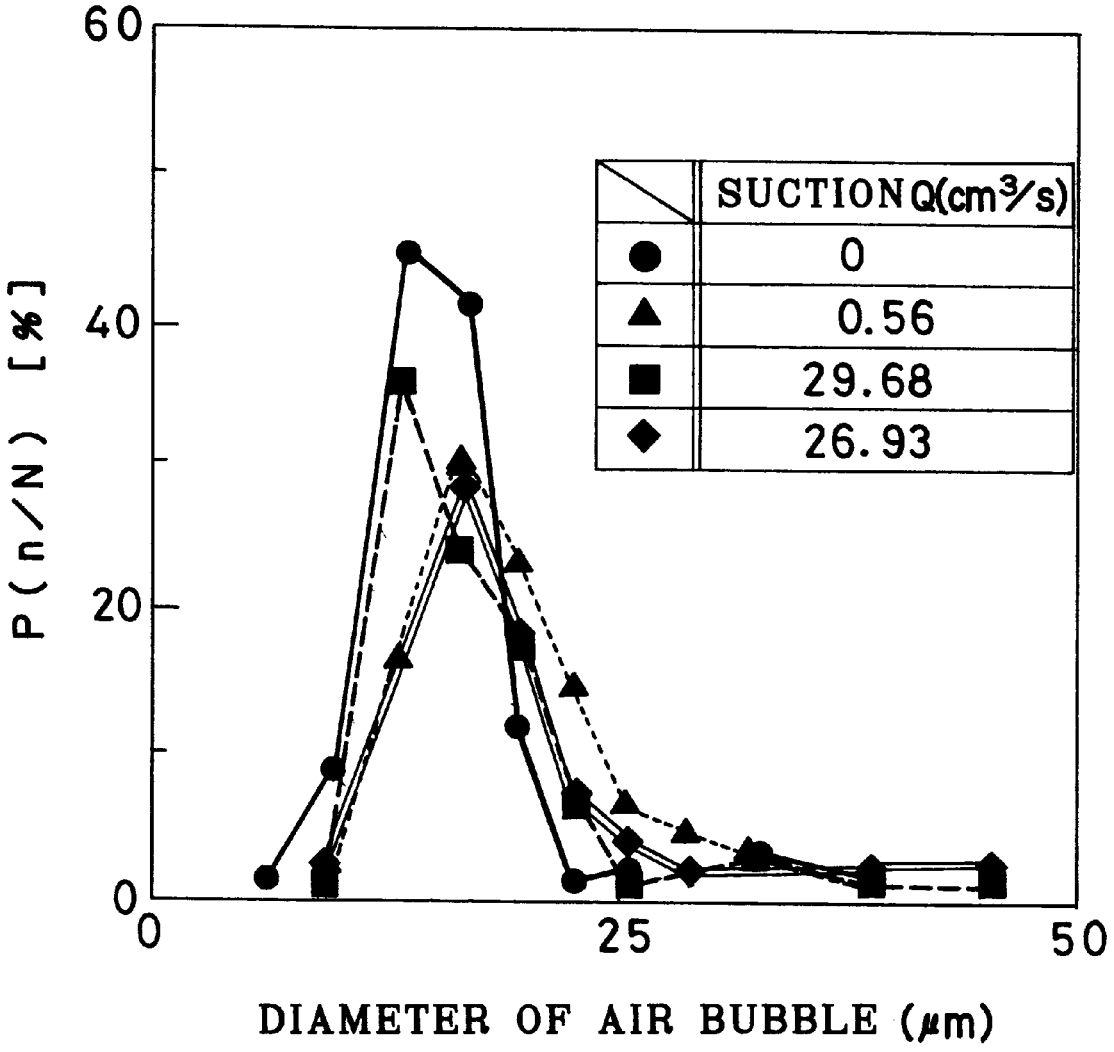
FIG. 15 is a graphic representation of the results, showing diameter of each of the air bubbles and distribution of air bubble generation frequency, when a medium type system according to the present invention was submerged into water and micro-bubbles were generated using the air as the gas.

FIG. 15 is a graphic representation of the results, i.e. diameter of air bubbles and distribution of generation frequency of air bubbles, when micro-bubbles were generated by installing a medium-size system as shown in FIG. 12 under water surface and using the air as the gas. The results when air suction quantity through the gas introducing hole 80 was adjusted are also shown. In this case, when suction was set to 0 $cm^3/s$, air bubbles of 10–20 $\mu$m in diameter were generated. This may be attributed to the fact that the air dissolved in water was separated and was turned to air bubbles. In this respect, the system according to the present invention can also be used as a deaerator for the dissolved gas.

When the system according to the present invention is installed in the liquid, and pressure liquid (e.g. water under pressure) is supplied into the conical space 100 through the pressure liquid inlet 500 via the pressure liquid introducing pipe 50 using storage pump, it is possible to easily generate and supply micro-bubbles of 10–25 $\mu$m in diameter in the liquid (e.g. water) by simply connecting the gas introducing pipe (e.g. air pipe) from outside to the gas introducing hole 80.

Figure 14:
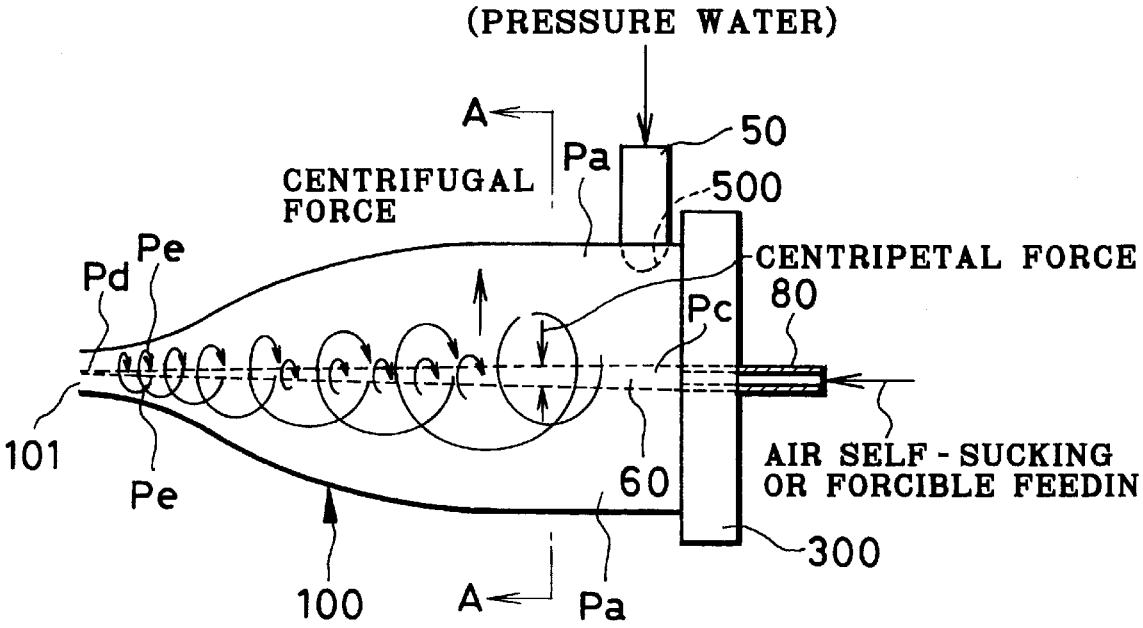
FIG. 14 is to explain a system of still another embodiment of the present invention.
Figure 14:
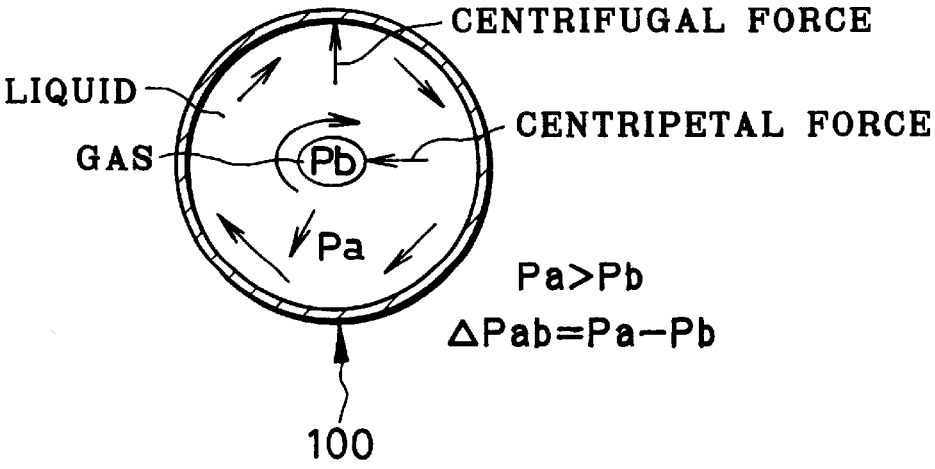

The above space may not always be in conical shape and may be designed in cylindrical shape with its diameter gradually increased (or gradually decreased). For example, it may be designed in shape of a bottle as shown in FIG. 14.

The generating condition of the air bubbles can be controlled by adjusting a valve (not shown) for gas flow rate control connected to the forward end of the gas introducing hole 80, and generation of optimal micro-bubbles can be easily controlled as desired. Further, it is possible to generate air bubbles having diameter of larger than 10–20 $\mu$m by such adjustment.

By the control of diameter of air bubbles to be generated, it is possible to generate micro-bubbles in size of several hundreds of $\mu$m without extremely reducing the amount of micro-bubbles with diameter of 10–20 $\mu$m.

Figure 13:
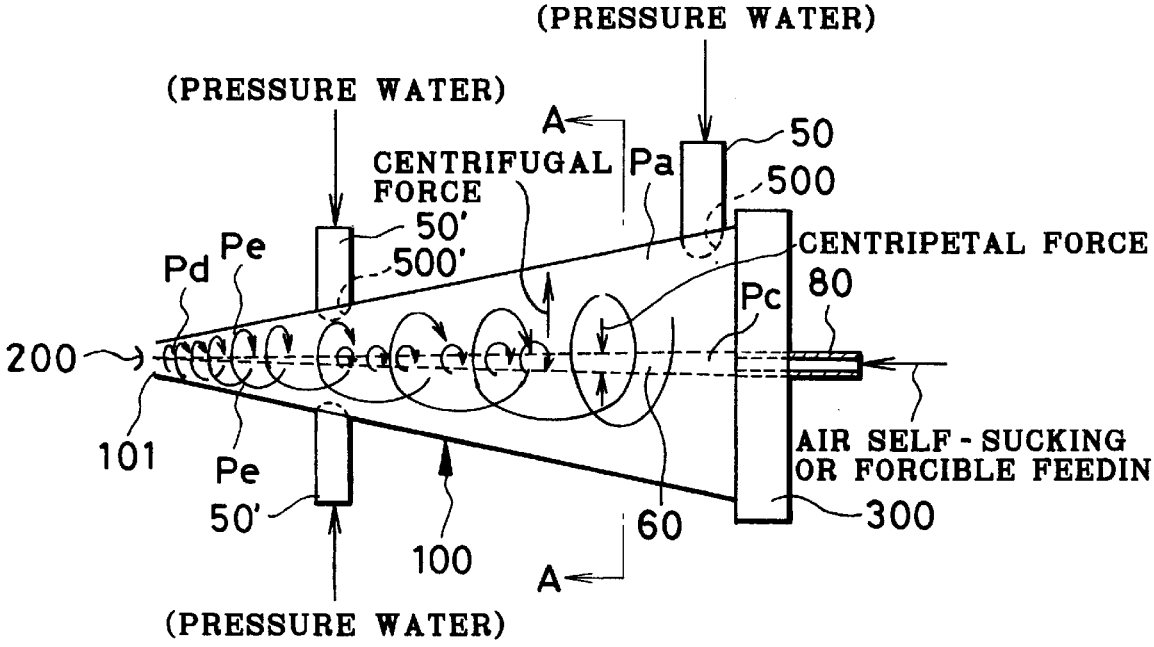
FIG. 13 is to explain a system of another improved embodiment of the present invention.
Figure 13:
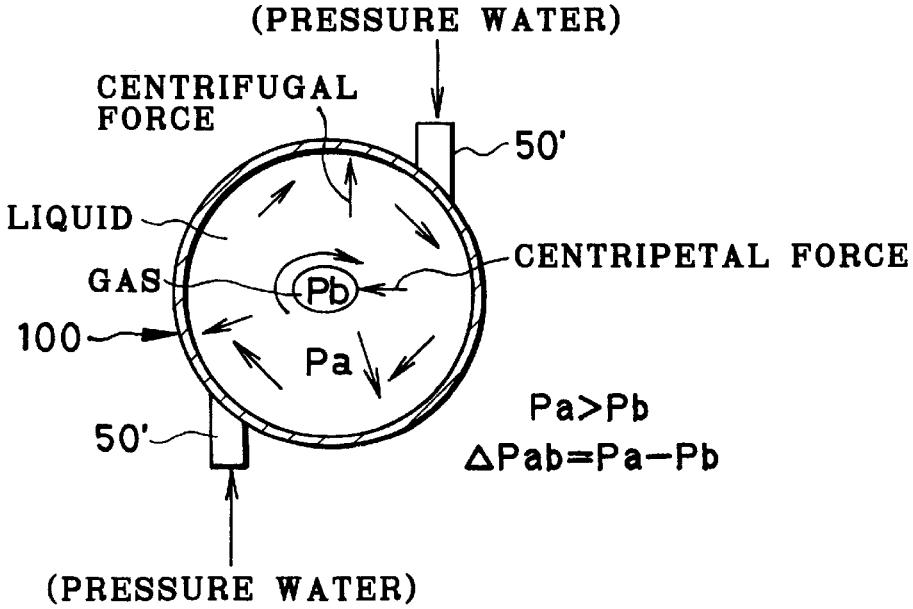

In an embodiment shown in FIG. 13, pressure liquid introducing pipes 50 and 50' are installed at two different points respectively, i.e. near the bottom 300 of the conical space and at a point before the swirling gas-liquid outlet 101

(i.e. two or more pipes may be installed in tangential direction with spacings between them on circumferential surface of inner wall having different radius of curvature). When the liquid is supplied by extensively increasing the liquid introducing pressure from the pressure liquid inlet 500' on the left side to a value higher than the introducing pressure through the pressure liquid inlet 500 on the right side. As a result, number of revolutions of the liquid on the left side can be extensively increased, and air bubbles can be generated.

By adjusting the pressure of the pressure water sent through the pressure liquid inlets 500 and 500', air bubbles having any diameter can be generated. Reference numeral 200 represents a baffle plate, and this is helpful in promoting generation and diffusion of micro-bubbles.

In the following, description will be given on a micro-bubble generating system according to another embodiment of the present invention.

Figure 1:
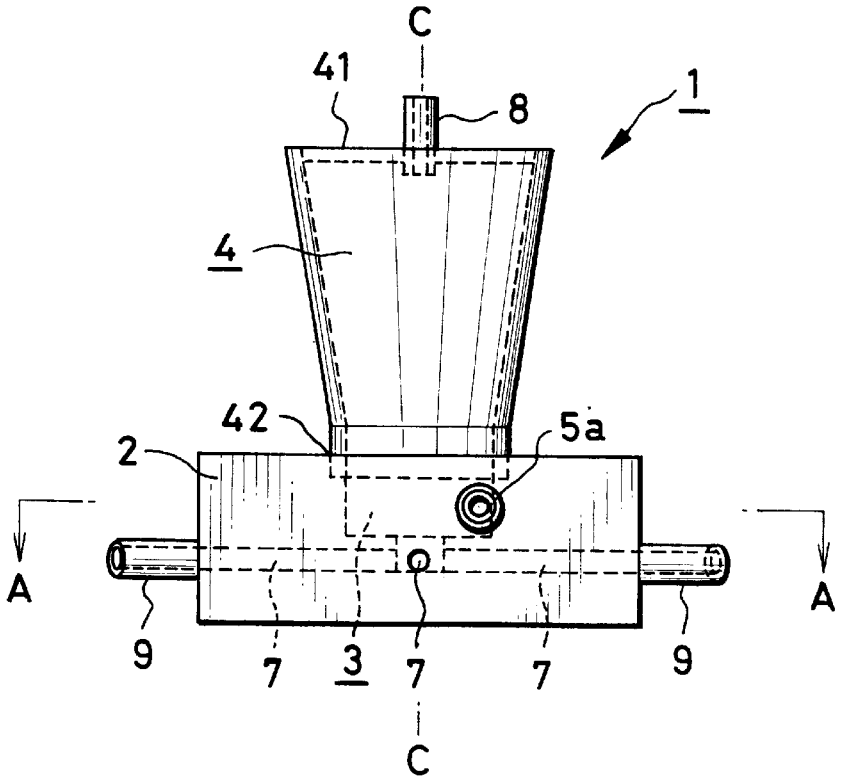
FIG. 1 is a front view of a swirling type micro-bubble generating system of an embodiment according to the present invention.
Figure 2:
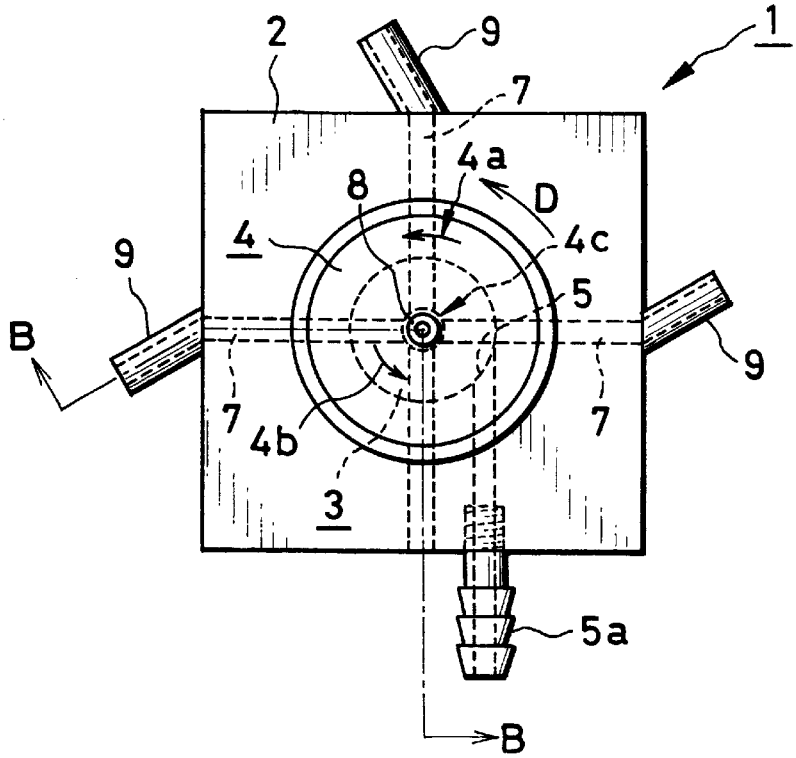
FIG. 2 is a plan view of the above.
Figure 3:
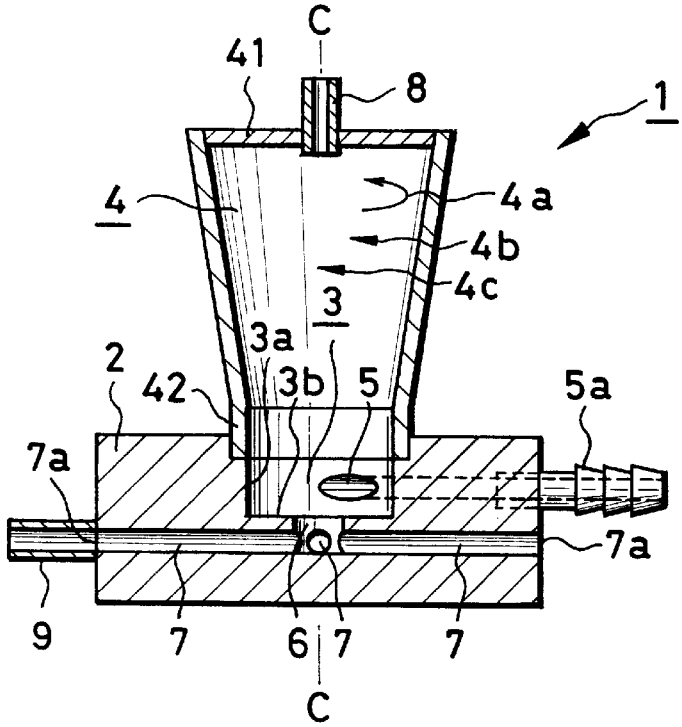
FIG. 3 is a longitudinal sectional view at the center along the line B—B in FIG. 2.
Figure 4:
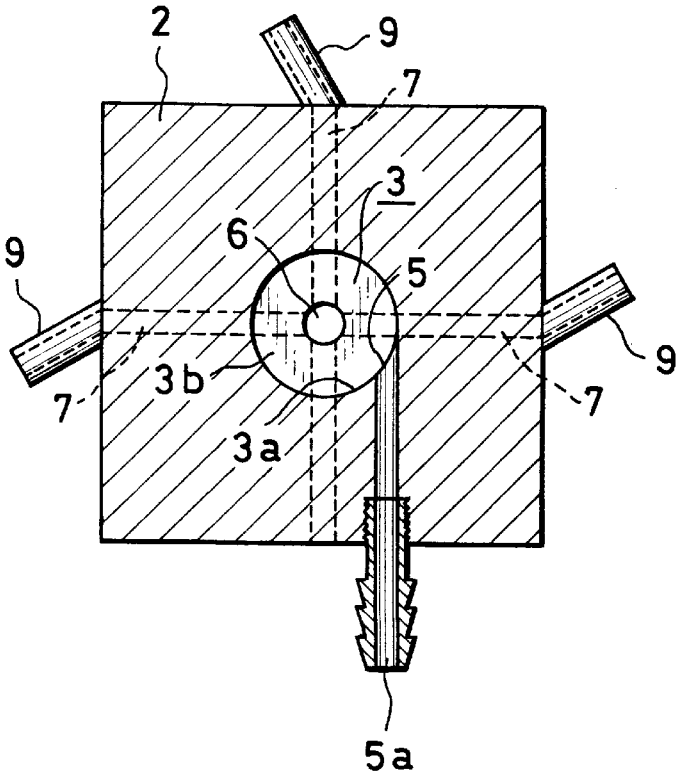
FIG. 4 is a lateral sectional view of a lower flow base along the line A—A in FIG. 1.
Figure 5:
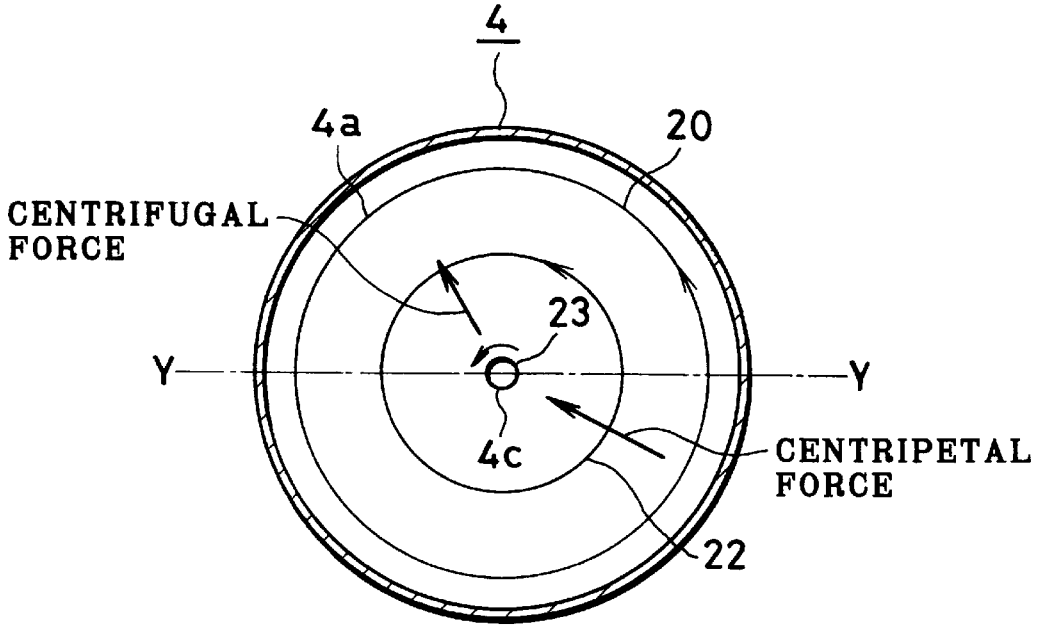
FIG. 5 is a drawing to explain triple swirling flows on a cross-section of inner space of a covered cylinder along the line X—X.
Figure 7:
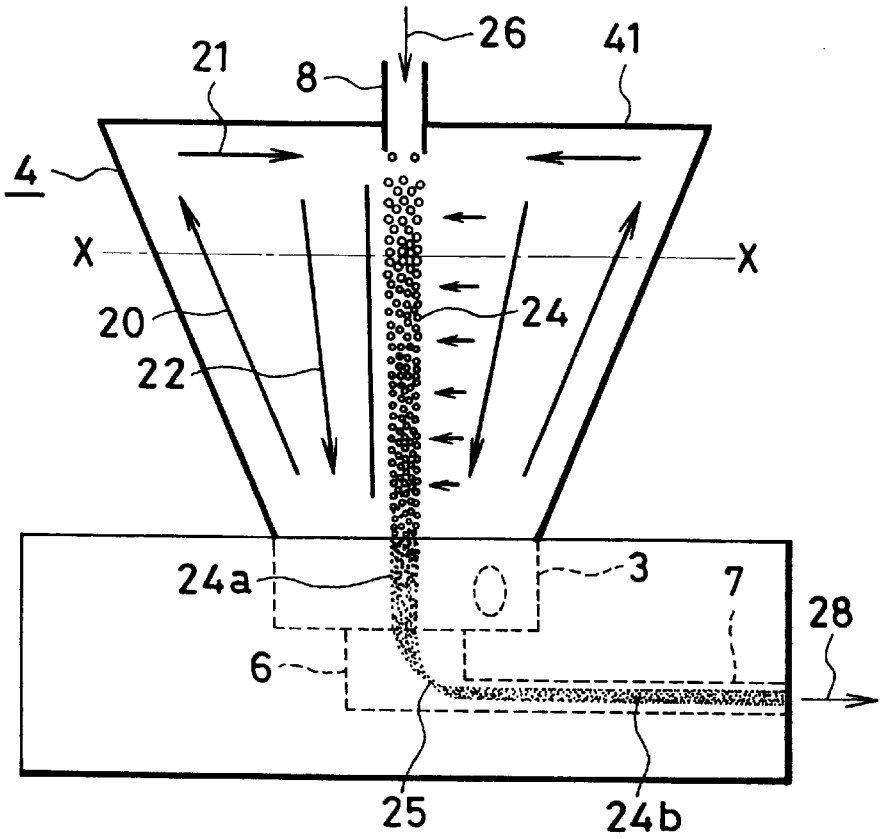
FIG. 7 is a drawing to explain generation of micro-bubbles in the gas vortex flow.
Figure 8:
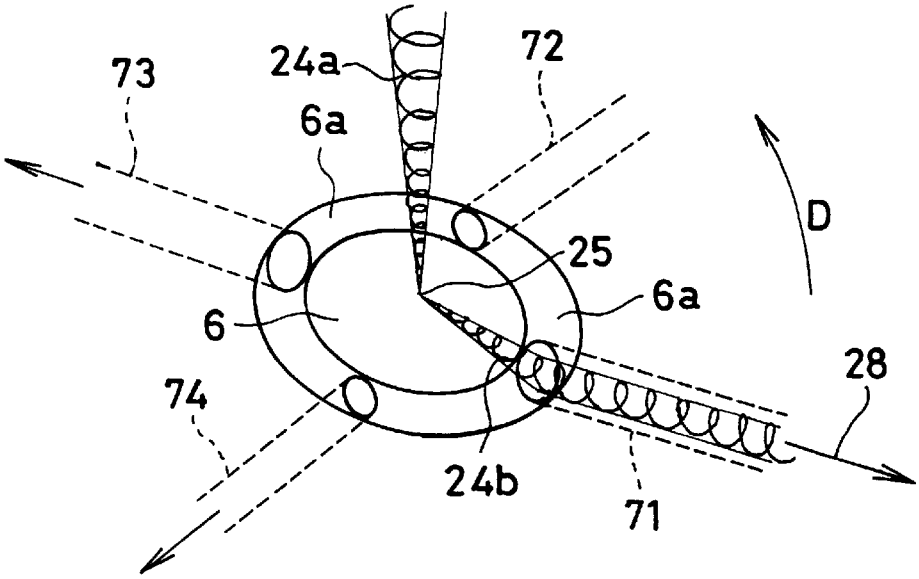
FIG. 8 is a drawing to explain a micro-bubble generating mechanism having four lateral discharge ports on a central reflux outlet.
Figure 9:
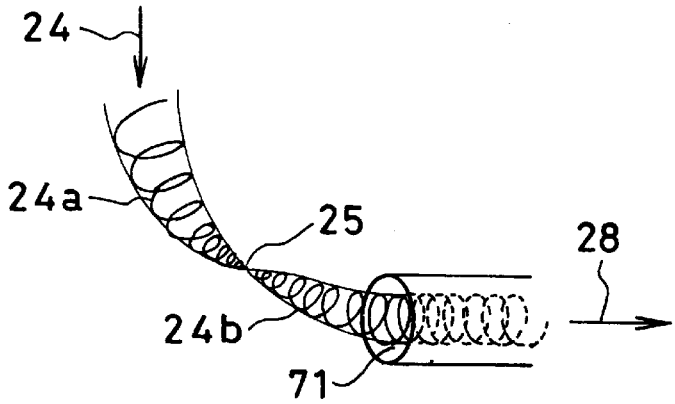
FIG. 9 is a drawing to explain the micro-bubble generating mechanism at a first lateral discharge port of FIG. 8.
Figure 10:
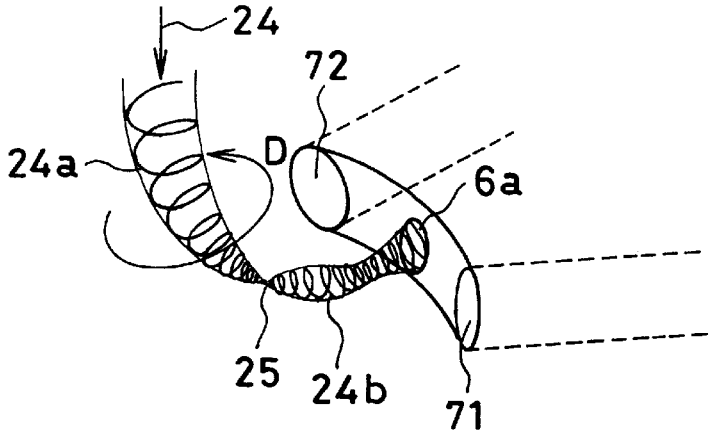
FIG. 10 is a drawing to explain the micro-bubble generating mechanism as seen on a side wall adjacent to the first lateral discharge port of FIG. 8.
Figure 11:
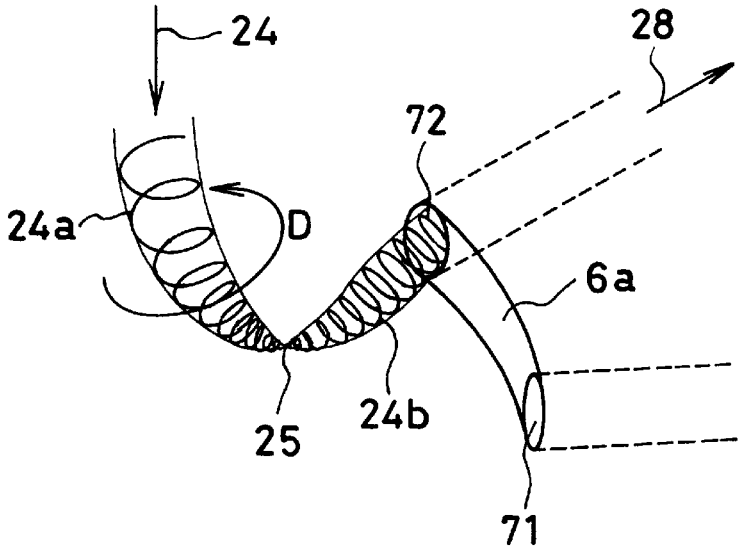
FIG. 11 is a drawing to explain the micro-bubble generating mechanism as seen on a second lateral discharge port of FIG. 8.
Figure 16:
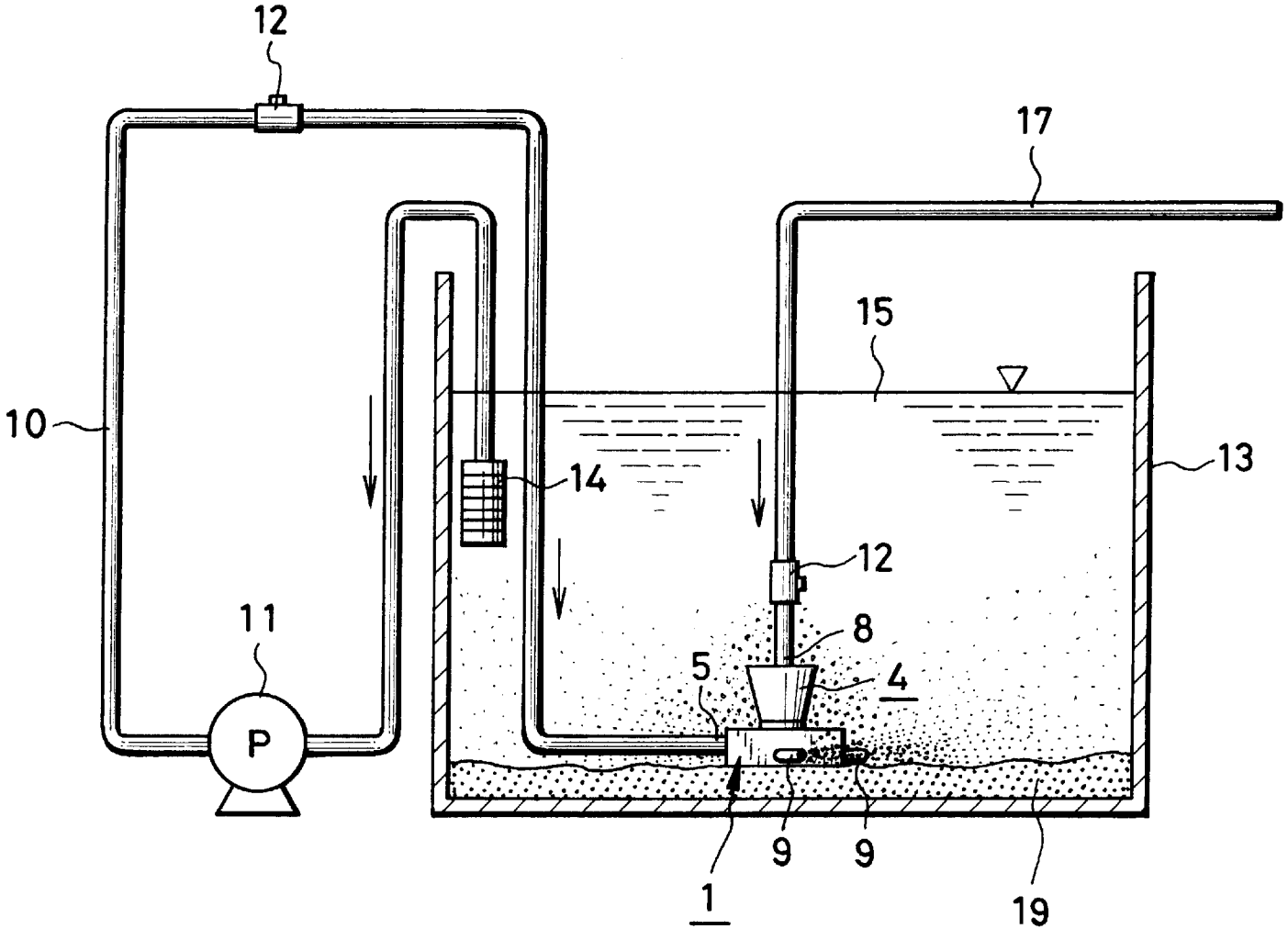
FIG. 16 is a drawing to explain the system of an embodiment of the present invention when it is installed in a water tank.

FIG. 1 is a front view of a swirling type micro-bubble generating system of an embodiment according to the present invention; FIG. 2 is a plan view of the above; FIG. 3 is a longitudinal sectional view at the center along the line B—B in FIG. 2; FIG. 4 is a lateral sectional view of a lower flow base along the line A—A in FIG. 1; FIG. 5 is a drawing to explain triple swirling flows on a cross-section of inner space of a covered cylinder along the line X—X; FIG. 6 is a drawing to explain swirling ascending flow and descending flow and a gas vortex flow in the above embodiment along the line Y—Y; FIG. 7 is a drawing to explain generation of micro-bubbles in the gas vortex flow; FIG. 8 is a drawing to explain a micro-bubble generating mechanism having four lateral discharge ports on a central reflux outlet; FIG. 9 is a drawing to explain the micro-bubble generating mechanism at a first lateral discharge port of FIG. 8; FIG. 10 is a drawing to explain the micro-bubble generating mechanism as seen on a side wall adjacent to the first lateral discharge port of FIG. 8; FIG. 11 is a drawing to explain the micro-bubble generating mechanism as seen on a second lateral discharge port of FIG. 8; FIG. 12 is to explain a system of another embodiment, also serving to explain the principle of the present invention; FIG. 13 is to explain a system of another improved embodiment of the present invention; FIG. 14 is to explain a system of still another embodiment of the present invention; FIG. 15 is a graphic representation of the results, showing diameter of each of the air bubbles and distribution of air bubble generation frequency, when a medium type system according to the present invention was submerged into water and micro-bubbles were generated using the air as the gas; and FIG. 16 is a drawing to explain the system of an embodiment of the present invention when it is installed in a water tank.

In the figures, reference numeral 1 is a swirling type micro-bubble generating system, 2 is a lower flow base, 3 is a circular accommodation chamber, 4 is a covered cylinder, 5 is a liquid inlet, 6 is a central reflux port, 7 is a lateral discharge port, 8 is a gas self-sucking pipe, 20 is a swirling ascending liquid flow, 22 is a swirling descending liquid flow, 23 is a swirling cavity under negative pressure, 24 is a gas vortex flow, and 25 is a cutoff sector.

Structurally, the swirling type micro-bubble generating system 1 according to the present invention can be roughly divided to the following unit structures: a liquid swirling introducing structure where liquid flow is forcibly introduced and swirled into the circular accommodation chamber 3 of the lower flow base 2, a swirling ascending liquid flow forming structure positioned above the circular accommodation chamber 3 and formed in a peripheral portion 4*a* of a covered cylinder 4 designed in shape of an inverted circular cone with its diameter gradually increased upward, a swirling descending liquid flow forming structure provided on a portion 4*b* inside the peripheral portion 4*a*, a micro-bubble generating structure, comprising a swirling cavity 23 under negative pressure formed in the central portion 4*c* by centrifugal and centripetal forces of dual swirling flows, i.e. a swirling ascending liquid flow 20 and a swirling descending liquid flow 22, a unit for forming a gas vortex flow 24, which contains a self-sucking gas 26 and an eluted gas 27 in the swirling cavity 23 under negative pressure, descending and swirling while being extended and narrowed down, the gas vortex flow 24 undergoes resistance when entering the central reflux port 6, difference of swirling velocity occurs between the upper portion 24*a* and the lower portion 24*b* of the vortex flow, the vortex flow 24 is forcibly cut off and micro-bubbles are generated, and a swirling injection structure where the generated micro-bubbles are incorporated in the swirling descending liquid flow and it is discharged out of the system through the lateral discharge port 7 as a swirling injection flow.

At the upper center of the lower flow base 2 designed in cubic shape, the circular accommodation chamber 3 is provided. On inner peripheral surface 3*a* of the circular accommodation chamber 3, a liquid inlet 5 is opened toward the inner peripheral surface 3*a* in tangential direction. To a water pipe connection 5*a* mounted on outer intake sector of the inlet 5, a water pipe 10 is connected, which has a pump 11 for water supply (FIG. 12) and a flow control valve 12 (may be mounted outside and not underwater) are mounted at the middle of the water pipe 10. Water flow is forcibly introduced to the inner peripheral surface 3*a* of the circular accommodation chamber 3 in tangential direction counterclockwise, and a swirling introducing flow running in the direction of an arrow D (counterclockwise) in the figure is formed.

On an opened step of the circular accommodation chamber 3, a cylindrical portion 42 at the lower end of the cylinder is engaged, and the covered cylinder 4 designed in inverted circular cone with its diameter gradually increased upward is erected. Reference numeral 41 is a flat upper cover of the cylinder. Along the central axis (C—C) of the upper cover 41, a gas suction pipe 8 is inserted and directed downward, and the gas is automatically sucked into the swirling cavity 23 under negative pressure formed at the central portion 4*c* as to be described later.

As described above, the gas-liquid mixed flow introduced and swirled in the direction of D into the circular accommodation chamber 3 is sent into the covered cylinder 4 while maintaining its swirling force, and the flow ascends and swirls along inner peripheral portion 4*a* and forms a swirling ascending liquid flow 20. The swirling ascending liquid flow runs along inner peripheral surface of the cylinder with its diameter gradually increased, and while gradually increasing the swirling velocity and it reaches upper end of the cylinder 4. Then, it flows back in the direction of an arrow 21 toward the inner portion 4*b* from the peripheral portion 4*a* and begins to descend while swirling, and the swirling descending liquid flow 22 is formed. Next, by centrifugal and centripetal forces of dual swirling flows, i.e. the swirling ascending liquid flow 20 and the swirling descending liquid flow 22, the swirling cavity 23 under negative pressure is formed at the central portion 4*c* of the cylinder 4.

Because the swirling descending flow area is gradually reduced along the central axis (C—C) in shape of an inverted circular cone of the cylinder 4, the swirling velocity is increased, while internal pressure is reduced. Therefore, the shape of the swirling cavity 23 at the central portion 4*c* is extended and narrowed down. With the extension of the swirling cavity, internal pressure is more and more reduced. Thus, from the swirling descending liquid flow 22 moving around the cavity, the air contained in the water flow is eluted.

On the other hand, into the swirling cavity 23 under negative pressure, which descends while swirling, the air is automatically sucked via the gas self-sucking pipe 8. The self-sucking gas 26 and the eluted gas 27 coming from the swirling flow are accumulated in the swirling cavity 23 under negative pressure, and a gas vortex flow 24 is formed, which swirls and descends while being extended and narrowed down.

Micro-bubbles cannot be generated only by the formation of the gas vortex flow 24, which swirls and descends along the central axis (C—C). In the micro-bubble generating system 1 according to the present invention, as shown in FIG. 7, during the process where the flow is discharged through the central reflux port 6 with respect to the gas vortex flow 4, the flow undergoes the resistance in the discharge passage, and difference in swirling velocity is generated between the upper portion 24*a* and the lower portion 24*b* of the gas vortex flow 24. The gas vortex flow 24 is forcibly twisted and cut off, and micro-bubbles are generated.

The smaller the diameter of the cross-section of the gas vortex flow 24 is, the more favorable condition is obtained for generation of micro-bubbles. The diameter of the cross-section can be easily controlled by adjusting the self-sucking amount of the air from the gas self-sucking pipe 8 by the flow control valve 12 (FIG. 15). The more the self-sucking amount of the air is, the more the diameter of the cross-section of the gas vortex flow is increased. When the amount of self-sucking reaches zero, the diameter takes the minimal value. When the amount of the self-sucking gas is zero, the gas vortex flow 24 is formed only by the eluted gas 27 from the swirling descending liquid flow 22. In the purification of polluted water, which contains less amount of dissolved oxygen, special care must be taken on the ability of purification.

As described above, the micro-bubble generating mechanism in the system according to the present invention comprises a first process where the swirling descending gas vortex flow 24 is formed in the covered cylinder 4 and a second process where swirling velocity difference occurs between the upper portion 24*a* and the lower portion 24*b* of the gas vortex flow 24, which swirls and descends while being extended and narrowed down, the flow undergoes resistance in the discharge passage, and micro-bubbles are generated when the gas vortex flow is forcibly twisted and cut off.

In the present system 1, a central reflux port 6 is formed, vertically along the central axis (C—C) of the bottom 3*b* of the circular accommodation chamber 3, as a discharge passage to discharge the swirling descending liquid flow 22, which swirls and descends in the cylinder 4. Further, four lateral discharge ports 7 are formed in radial direction toward four lateral sides of the lower flow base 2 from the central reflux port 6.

Micro-bubbles are generated when the swirling and descending gas vortex flow 24 is twisted and cut off. The micro-bubbles are then discharged out of the system through four lateral discharge ports 7 via the central reflux port 6 together with the swirling descending liquid flow 22. When discharged, the water flow is sent out as a discharge injection flow 28 while maintaining its swirling force.

Figure 17:
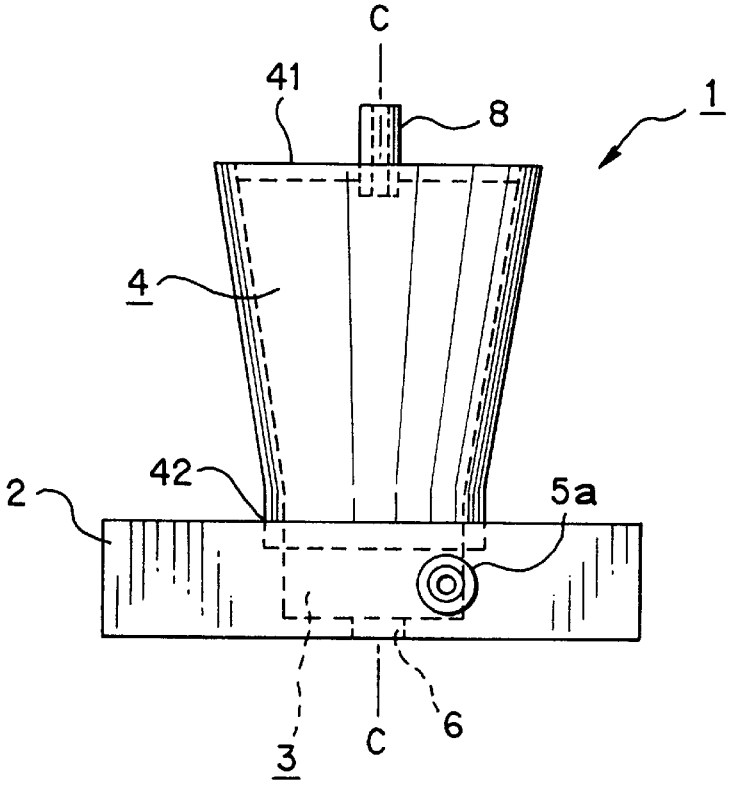
FIG. 17 is a front view of another embodiment of the swirling type micro-bubble generating system of the present invention.
Figure 18:
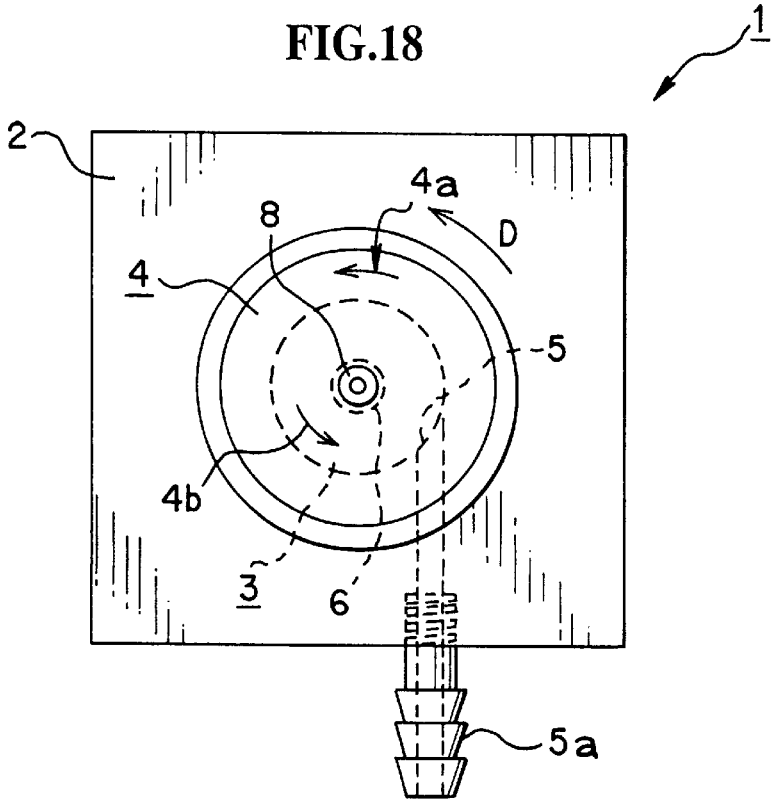
FIG. 18 is a plan view of the embodiment of FIG. 17.

These lateral discharge ports 7 may not be two or more ports but a single port may be used. Or, as shown in FIG. 17 and FIG. 18, the lateral discharge ports 7 may not be provided, and it may be designed in such manner that the diameter of the central reflux port is reduced toward the tip. Directly downward through this port, micro-bubbles are generated by cutting-off of the swirling and descending gas vortex flow (24) and the swirling and descending liquid flow (22) may be discharged.

Referring to FIGS. 8 to 11, description will be given now on micro-bubble generating mechanism when the central reflux port 6 is provided with four lateral discharge ports 71, 72, 73 and 74.

The gas vortex flow 24 swirls and descends in the central portion 4*c* of the covered cylinder 4. The vortex flow 24 is sent toward the four lateral discharge ports 71, 72, 73 and 74 through the central reflux port 6 together with the swirling descending liquid flow 22 in the direction of the arrow D. FIG. 9 shows the condition where the vortex flow is discharged into a first lateral discharge port 71. The lower portion 24*b* of the gas vortex flow undergoes resistance when it is sent and the swirling velocity is decreased. Then, difference in swirling velocity occurs between the lower portion 24*b* and the upper portion 24*a* of the gas vortex flow. The vortex flow is twisted and cut off, and micro-bubbles are generated. Reference numeral 25 indicates a sector where the vortex flow is cut off.

FIG. 10 shows the condition where the gas vortex flow 24 undergoes resistance as it collides with an adjacent reflux port side wall 6*a* while the vortex flow is advancing toward a second lateral discharge port 72. When collided with the side wall 6*a*, the lower portion 24*b* of the vortex flow changes its swirling velocity, and micro-bubbles are generated at the cutting sector 25.

FIG. 11 shows the condition where the gas vortex flow 24 is discharged into the second discharge port 72. With a swirling velocity different from that of FIG. 10, the cutting sector 25 occurs, and micro-bubbles are generated.

As described above, while the vortex flow is revolved by one turn, it is discharged into each of the four lateral discharge ports 71, 72, 73, and 74 and repeatedly and alternately collided with adjacent side wall 6*a*. Each time, swirling velocity difference occurs between the upper portion 24*a* and the lower portion 24*b* of the vortex flow. Thus, the vortex flow is cut off and a large amount of micro-bubbles are generated.

The number of the lateral discharge ports 7 is related to the number of swirling of the swirling flow 22 and the gas vortex flow 24 and the number of cutting sectors 25. In order to increase the number of swirling, it is necessary to induce the swirling of the liquid in early stage using high pressure pump. The more the number of the swirling is increased, the smaller the cutting sector (area) 25 becomes. As a result, elution of the gas due to negative pressure is promoted, and a larger amount of smaller micro-bubbles can be generated. When the number of the lateral discharge ports 7 is increased, the number of micro-bubbles is increased. The results of the experiment reveal that, if the number of revolutions is at constant level, the number of optimal discharge ports is related to the amount of the introduced liquid. Under the condition where a pump of 40 liters/min. and with head of water of about 15 m is used, the optimal number of discharge ports is four.

At the outlet 7*a* of the lateral discharge port 7 in the lower flow base 2, a connection pipe 9 for discharge is connected. Because discharge direction is deflected at an angle of 45° in the direction of the arrow D in association with the direction to form the swirling flow in the covered cylinder 4 (direction of the arrow D), when the swirling type micro-bubble generating system 1 of the present invention is installed in a water tank 13 (FIG. 15), a circulating flow running in the direction of the arrow D is formed around the swirling type generating system 1 as it is discharged as a swirling injection flow from the discharge connection pipe 9 into the water tank 13. As a result, micro-bubbles containing oxygen are evenly distributed in the water tank 13.

In the micro-bubble generating system 1 according to the present invention as described above, water flow containing micro-bubbles with diameter of 10–20 $\mu$m in an amount of more than 90% can be discharged through the discharge port.

When the system is installed in the water tank 13, it is preferable that a weighty material is used as the lower flow base 2. In case it is made of plastics, a heavy stainless steel plate may be attached on the bottom. If the covered cylinder 4 is made of a transparent material, it is advantageous in that the formation of the swirling ascending liquid flow and the swirling descending liquid flow inside can be directly observed.

The system of the present invention may be made of the materials such as plastics, metal, glass, etc., and it is preferable that the components of the system are integrated together by bonding, screw connection, etc.

INDUSTRIAL APPLICABILITY

By the swirling type micro-bubble generating system of the present invention, it is possible to readily generate micro-bubbles in industrial scale. Because the system is relatively small in size and has simple construction, it is easier to manufacture, and the system will contribute to purification of water in ponds, lakes, marshes, man-made lakes, rivers, etc., processing of polluted water using microorganisms, and culture of fishes and other aquatic animals.

Micro-bubbles generated by the system according to the present invention can be used in the following applications:

(1) Purification of water quality in man-made lakes, natural lakes, ponds, rivers, sea, etc. and preservation of natural environment through growth of animals and microorganisms.

(2) Purification of man-made and natural waters such as biotope and promotion of growth of fireflies, water weeds, etc.

(3) Industrial applications

Diffusion of high temperature in steel manufacture.

Promotion of acid cleaning of stainless steel plate and wires.

Removal of organic substances in ultra-pure water manufacturing factory.

Removal of organic substances in polluted water by micro-bubble formation of ozone, increase of dissolved oxygen, sterilization, manufacture of synthetic resin foam such as urethane foam product.

Processing of various types of waste water and liquid.

Sterilization by ethylene oxide, promotion of mixing of ethylene oxide with water in sterilizer.

Emulsification of defoaming agent.

Aeration of polluted water in activated sludge treatment method.

(4) Agricultural applications

Increase of oxygen and dissolved oxygen to be used in hydroponic culture, and improvement of production yield.

(5) Fisheries

Culture of eel

Maintenance of life in cuttlefish tank

Culture of yellowtail

Artificial development of seeweeds

Promotion of growth of fishes

Prevention of red tide (6) Medical applications

Use of micro-bubbles in hot bath to promote blood circulation and to maintain hot water in bath.

What is claimed is:

1. A micro-bubble generating system, comprising a container main unit having a conical space having a bottom portion of a diameter greater than a top portion, a pressure liquid inlet provided in tangential direction to a part of a circumferential surface on an inner wall of said conical space, a gas introducing hole opened on the bottom portion of said conical space for entry of gas into said conical space, and a swirling gas-liquid outlet arranged at the top portion of said conical space, wherein a length of the conical space along its central axis is 1.5–2.0 times the diameter of the bottom portion.

2. A micro-bubble generating system according to claim 1, wherein a plurality of pressure liquid inlets are provided with spacings in tangential direction to a part of the circumferential surface having the same radius of curvature on the inner wall of said conical space.

3. A micro-bubble generating system according to claim 1, wherein a plurality of pressure liquid inlets are provided with spacings in tangential direction to parts of the circumferential surface having different radii of curvature on the inner wall of said conical space, and the pressure of the pressure liquid at a location having a smaller radius of curvature is greater than the pressure of the pressure liquid at a location having a larger radius of curvature.

4. A micro-bubble generating system according to claim 1, wherein said pressure liquid inlet is provided on a part of the circumferential surface of the inner wall near the bottom portion of said conical space.

5. A micro-bubble generating system according to claim 1, wherein said pressure liquid inlet is provided on a part of the circumferential surface of the inner wall near a point substantially halfway between the bottom portion and top portion of said conical space.

6. A micro-bubble generating system according to claim 1, wherein a baffle plate is arranged downstream of the swirling gas-liquid outlet.

7. A method for micro-bubble generation, using a micro-bubble generating system, which comprises a container main unit having a conical space having a bottom portion of a diameter greater than a top portion, a pressure liquid introducing port opened in tangential direction to apart of a circumferential surface on an inner wall of said conical space, a gas introducing hole opened at the bottom portion of said conical space for entry of gas into said conical space, and a swirling gas-liquid discharge outlet opened at the top portion of said conical space, whereby said method comprises a first step of forming a gas vortex flow swirling and flowing while being extended and narrowed toward said top portion of said conical space, and a second step of generating micro-bubbles when the gas vortex flow is forcibly cut off due to the difference of swirling velocity between an upper portion and a lower portion of the gas vortex flow, wherein a length of the conical space along its central axis is 1.5–2.0 times the diameter of the bottom portion.

* * * * *